US009980621B1

(12) United States Patent
Morad et al.

(10) Patent No.: US 9,980,621 B1
(45) Date of Patent: May 29, 2018

(54) FLUID DISPENSER HAVING A LIQUID RELEASE BOTTLE WITH SUCTION BELLOWS OR A LIQUID SQUEEZE BOTTLE INCORPORATED INTO A FLAT MOP

(71) Applicants: Fred I. Morad, Toluca, CA (US); Robert A. Acosta, Norwalk, CA (US)

(72) Inventors: Fred I. Morad, Toluca, CA (US); Robert A. Acosta, Norwalk, CA (US)

(73) Assignee: Worldwide Integrated Resources, Inc., Montebello, CA (US)

( * ) Notice: Subject to any disclaimer, the term of this patent is extended or adjusted under 35 U.S.C. 154(b) by 0 days. days.

(21) Appl. No.: 15/402,153

(22) Filed: Jan. 9, 2017

Related U.S. Application Data

(60) Provisional application No. 62/276,918, filed on Jan. 10, 2016.

(51) Int. Cl.
*A47L 1/08* (2006.01)
*A47L 13/22* (2006.01)
*A47L 13/23* (2006.01)

(52) U.S. Cl.
CPC ..... *A47L 13/22* (2013.01); *A47L 13/23* (2013.01)

(58) Field of Classification Search
CPC ..... A47L 13/22; A47L 13/23
USPC ..... 401/138
See application file for complete search history.

(56) References Cited

U.S. PATENT DOCUMENTS

| | | | | |
|---|---|---|---|---|
| 6,227,744 | B1 | 5/2001 | Fodrocy et al. | |
| 6,467,983 | B2 | 10/2002 | Fodrocy et al. | |
| 7,048,458 | B2 * | 5/2006 | Hall | A47L 13/22 222/518 |
| 7,491,005 | B2 * | 2/2009 | Blom | A47L 13/22 401/137 |
| 8,596,896 | B2 * | 12/2013 | Kimura | A47L 13/22 15/115 |
| 8,800,092 | B1 | 8/2014 | Morad et al. | |
| 2006/0280546 | A1 | 12/2006 | Dyer | |

FOREIGN PATENT DOCUMENTS

| | | |
|---|---|---|
| EP | 1273259 | 8/2003 |

* cited by examiner

*Primary Examiner* — Jennifer C Chiang
(74) *Attorney, Agent, or Firm* — Thomas I. Rozsa

(57) ABSTRACT

A fluid dispenser having a liquid release bottle with suction bellows which is incorporated into a flat mop. This embodiment includes an exterior wall, an interior chamber surrounded by an exterior wall and a cap on the liquid intake member. The exterior wall includes a suction bellows to create a suction within the interior chamber of the liquid release bottle. A downward force on the handle activates a suction bellows to create a suction on the interior chamber of the liquid release bottle enabling fluid retained in the interior chamber to flow out of a duck-bill valve and into flexible tubing which will then flow through the tubing and out an opening of a yoke so that the fluid can flow onto a front of a scrubbing portion of the mop to facilitate cleaning. An alternative embodiment replaces the liquid release bottle with a liquid squeeze bottle.

9 Claims, 11 Drawing Sheets

FLUID DISPENSER HAVING A LIQUID RELEASE BOTTLE WITH SUCTION BELLOWS OR A LIQUID SQUEEZE BOTTLE INCORPORATED INTO A FLAT MOP

CROSS-REFERENCE TO RELATED APPLICATION

This patent application claims priority to Provisional Application Ser. No. 62/276,918 filed on Jan. 10, 2016.

BACKGROUND OF THE INVENTION

1. Field of the Invention

The present invention relates to the field of fluid dispensing apparatus incorporated into flat mops or used in conjunction with flat mops.

2. Description of the Prior Art

The general concept of incorporating fluid dispensing apparatus into a mop is illustrated by the following prior art patents and published patent applications of which the present inventor is aware.

1. U.S. Pat. No. 6,227,744 issued to Fodrocy et al. on May 8, 2001 for "LIQUID DISPENSING APPARATUS FOR CLEANING IMPLEMENTS".
2. U.S. Pat. No. 6,467,983 issued to Fodrocy et al. on Oct. 22, 2002 for "LIQUID DISPENSING APPARATUS FOR CLEANING IMPLEMENTS".
3. United States Patent Publication 2006/0280546 to John J. Dyer for "APPARATUS FOR DISPENSING LIQUID" published on Dec. 14, 2006.
4. European Patent Publication 1 273 259 published on Aug. 1, 2003 for "CLEANING DEVICE, AS WELL AS A PART FOR FORMING SUCH CLEANING DEVICE".

To the best of the present inventor's knowledge, only one of the devices set forth above has been commercialized. The present inventor, Fred I. Morad, is an innovator in the field of janitorial products, including but not limited to, different types of mops, and has determined that significant improvements are needed in the prior art apparatus disclosed in the above-referenced patents and published patent applications.

SUMMARY OF THE INVENTION

The present invention is a fluid dispensing apparatus incorporated into flat mops which enables fluid selected from the group consisting of water, cleaning fluid and concentrated cleaning fluid mixed with water, to flow out of a yoke portion of the mop so that the fluid is on the surface to be cleaned as the cleaning implement of the mop is pushed or scrubbed over and/or onto the surface to be cleaned. For purposes of the present invention, the yoke is a generally cylindrical member affixed at its distal end to the bottom end of a mop handle and affixed at its proximal end to a coupling member which movably connects the yoke to an upper surface of the flat mop housing. One example of a mop into which the present invention will be incorporated is disclosed and claimed in issued U.S. Pat. No. 8,800,092 issued to Fred I. Morad et al. on Aug. 12, 2014 for "APPARATUS TO REMOVE A DISPOSABLE CLOTH FROM A HAND OPERATED FLAT MOP THROUGH A SINGLE TRIGGER MECHANISM WITHOUT HAVING TO TOUCH THE DISPOSABLE CLOTH (the "'092 patent").

It is an object of the present invention to include the addition of a fluid dispenser having a liquid release bottle with suction bellows which is incorporated into a handle of a flat mop. Specifically, the liquid release bottle with suction bellows includes an exterior wall, an interior chamber surrounded by the exterior wall, an upper collar, a blocking member on the upper collar, a liquid intake member on the upper collar, and a cap on the liquid intake member. The exterior wall includes a suction bellows to create a suction within the interior chamber of the liquid release bottle. There is also an intake shaft on the upper collar to enable liquid to be inserted into the interior chamber of the release bottle. The exterior wall includes a suction bellows to create a suction within the liquid release bottle. The liquid release bottle also includes a one-way nipple valve located in the housing affixed to a shaft at a lower end of the liquid release bottle.

It is a further object of the present invention for the liquid release bottle to be incorporated into a flat mop in one of two ways. In a first and preferred version of the present invention, the above-described liquid release bottle is incorporated into the mop handler at a location adjacent an upper end of a mop handle with a separate integration member affixing an end cap of the mop to an upper collar of the liquid release bottle which enables a lower shaft from the liquid release bottle to be affixed to a flexible tubing which extends through an interior hollow chamber of the handle and adjoining yoke. The yoke is affixed to the bottom of the mop handle by an affixing member, which by way of example, is a crimping of the yoke onto the handle. The interior chamber of the handle is aligned with an interior chamber of the yoke. The flexible tubing extends through the aligned interior chambers of the mop handle and the yoke and extends out of a cutout in a portion of the wall of the yoke adjacent to the top surface of the mop.

It is therefore an object of the present invention to provide a liquid dispensing apparatus that facilitates cleaning liquid to flow out of the above-described tubing. The cleaning liquid is caused to flow out of the tubing with sufficient force to cause the cleaning liquid to land on the surface adjacent to the cleaning member of the flat mop. A liquid such as water or cleaning detergent fills the interior chamber of the release bottle by having a cap of a liquid intake member removed, having the liquid go into the chamber by either holding the liquid intake member on the upper collar of the release bottle to force liquid into the release bottle or simply have a pouring spout of a liquid container fill the reservoir within the interior chamber of the release bottle and then the end cap is closed so that the liquid will remain therein.

In a preferred valve embodiment for the first embodiment of the liquid release bottle with suction bellows, the liquid release bottle with suction bellows further includes a collar integrally formed with the liquid release bottle with suction bellows at its proximal end. A connection valve assembly is retained within a collar and includes a seal orifice including an O-ring seal, a duck-bill valve with an interior opening, and an air vent. Both an O-ring orifice and a duck-bill valve fit inside of an upper cylindrical portion of the connection valve. In addition, the connection valve has a bottom valve opening that connects to an opening of the handle interior channel by a bottom valve opening being surrounded by a bottom valve external circumferential wall that has a diameter sized to press fit and form an airtight connection with the opening of the handle interior channel located at the distal end of the tubing.

In a variation of the valve assembly for the first embodiment, the liquid release bottle includes a suction bellows at its distal end and a one-way nipple valve at its proximal end located at the bottom of the lower shaft of the housing retaining the one-way nipple valve. The nipple valve retains the liquid within the interior chamber of the release bottle. When it is desired to have liquid pour out of the end of a tubing which extends out of the opening or cutout in the yoke, a downward force on the handle causes the suction bellows to create an interior suction within the interior chamber of the liquid release bottle, thereby causing the one-way nipple valve to open and enabling cleaning fluid to be dispensed through the tubing at the bottom of the shaft of the housing retaining the one-way nipple valve and to flow out of the bottom end of the tubing and onto the surface to be cleaned so that the scrubbing action in using the mop is enhanced by the liquid in front of the flat mop on the surface to be cleaned.

In an alternative embodiment or second embodiment of the present invention, the liquid retaining bottle with a flexible bellows is replaced with a flexible liquid squeeze bottle which instead of requiring any force on the mop handle, is directly squeezed by the hand to enable the liquid to flow from a force through liquid retained in the liquid retaining squeeze bottle through the cleaning liquid within the bottle and through the flexible tubing as described in the first embodiment extending through the cutout in the yoke and being sprayed onto the surface to be cleaned. The liquid retaining squeeze bottle is also located adjacent the top of the mop handle so that it is easily accessible to an individual seeking to squeeze the bottle and cause the forced liquid to go through the tubing an onto the floor.

The present invention can be incorporated into various mops including, but not limited to, the mop disclosed and claimed in the '092 patent.

Defined broadly, the first embodiment of the present invention is an apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising: (a) a fluid dispenser having a liquid release bottle with suction bellows incorporated into the handle, the liquid release bottle with suction bellows including an interior surface surrounding an interior chamber, a fluid intake member affixed to and in fluid communication with the liquid release bottle and suction bellows; (b) the handle having a handle longitudinal interior channel extending from a location adjacent a lower end of said liquid release bottle to the proximal end of the yoke, said yoke having a yoke longitudinal interior channel extending from the location where the yoke is connected to said handle to a cutout in said yoke, the handle longitudinal interior channel aligned with the yoke longitudinal interior channel; and (c) the liquid release bottle having a proximal end in fluid communication with a one-way valve and in fluid communication with a distal end of a flexible tubing which extends through said aligned handle longitudinal interior channel and said yoke longitudinal interior channel, the flexible tubing extending out of said cutout in said yoke and terminating at a proximal end adjacent an upper surface of the flat mop; (d) whereby the interior chamber of the liquid release bottle is filled with cleaning liquid through the fluid intake member and a downward force on the mop handle causes the suction bellows to create an interior suction within the interior chamber of the liquid release bottle, thereby causing the one-way valve to open and enabling cleaning liquid to be dispensed through the flexible tubing, the cleaning liquid lowing out of the proximal end of the tubing and at a location distal from said flat mop and onto a surface to be cleaned by the flat mop.

Further novel features and other objects of the present invention will become apparent from the following detailed description and discussion.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
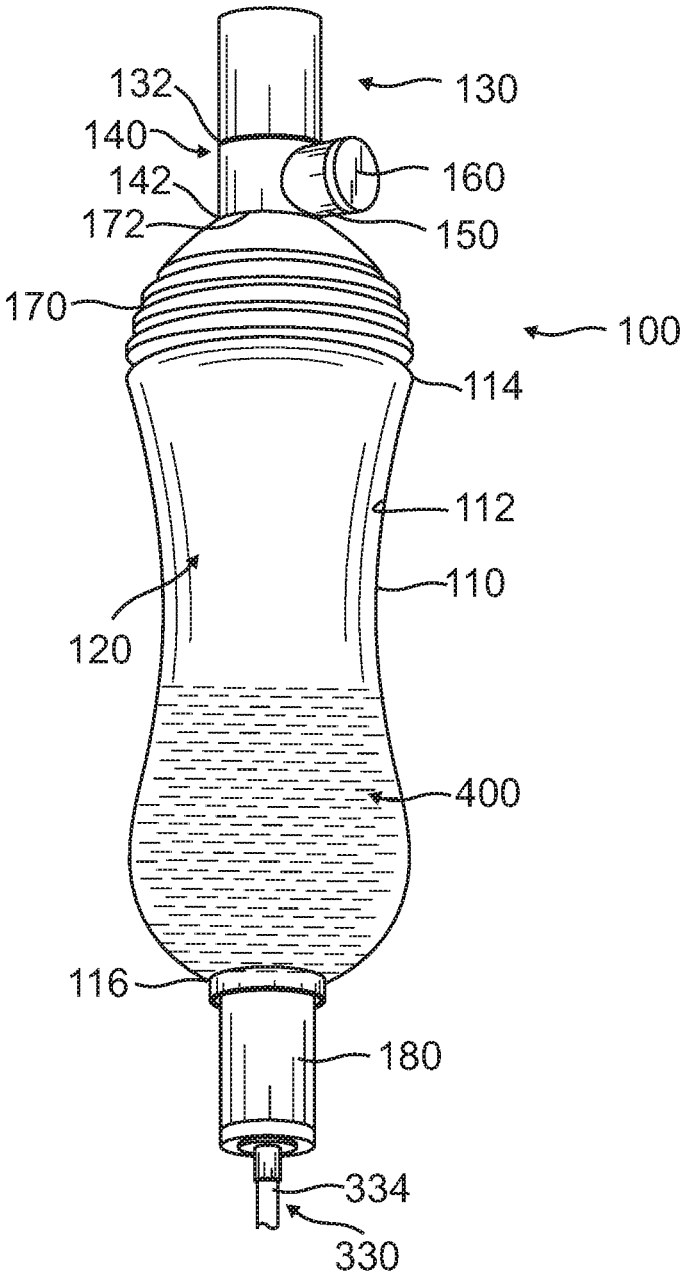
FIG. 1 is a perspective view of a preferred or first embodiment of the present invention liquid release bottle with suction bellows.
Figure 1A:
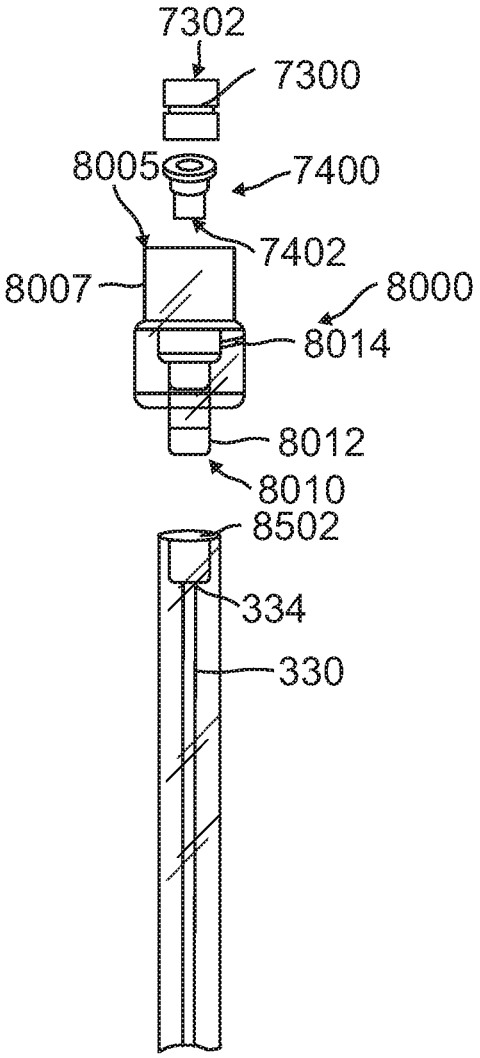
FIG. 1A is a partially exploded view of the valve assembly for the first embodiment liquid release bottle (the same valve assembly is used with the alternative embodiment or second embodiment of the present invention liquid squeeze bottle) showing a connection valve, a duck-bill valve, an O-ring, and the connection to the flexible tubing.
Figure 2:
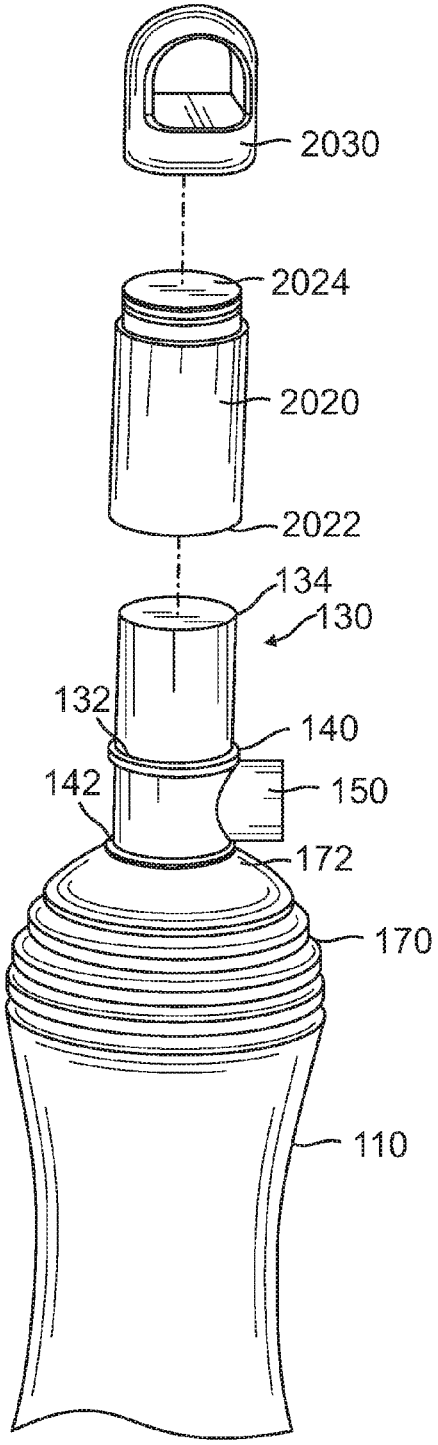
FIG. 2 is an exploded view of a liquid release bottle affixed adjacent an upper end of a mop handle showing the operation of the liquid release bottle, an integration member and an end cap.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention.

Referring to FIGS. 1-6, there is illustrated a preferred or first embodiment of the present invention liquid release bottle with suction bellows 100. The liquid release bottle with suction bellows 100 includes an exterior wall 110 having an interior surface 112 surrounding an interior chamber 120. At a distal end, an upper collar 130 which retains a blocking member 140 includes a liquid intake member 150 which is covered by a cap 160. Liquid such as water or cleaning fluid (jointly 400) is poured into the interior chamber 120 of the liquid release bottle with suction bellows 100 by removing the cap 160, inserting the liquid 400 from a liquid retaining source such as a bottle or faucet (not shown) through the liquid intake member 150 and then closing the cap 160. The liquid intake bottle further includes a suction bellows member 170 formed into a distal end 114 of the exterior wall 110. The liquid release bottle with suction bellows 100 further includes a collar 180 integrally formed with the liquid release bottle with suction bellows 100 at its proximal end 116. A connection valve assembly 8000 is retained within collar 180, and includes a seal orifice 7302 including an O-ring seal 7300; a duck-bill valve 7400 with an interior opening 7402, and an air vent 8014. Both O-ring orifice 7302 and duck-bill valve 7400 fit inside of upper cylindrical portion 8007 of connection valve 8000. In addition. connection valve 8000 has a bottom valve opening 8010 that connects to flexible tubing 330 by a handle interior channel opening 8502. The bottom valve opening 8010 is surrounded by a bottom valve external circumferential wall 8012 that has a diameter sized to press fit and form an airtight connection with the handle interior channel opening 8502 at the distal end 334 of flexible tubing 330. A broader definition of the connection valve assembly 8000 is "a one-way valve."

Figure 3:
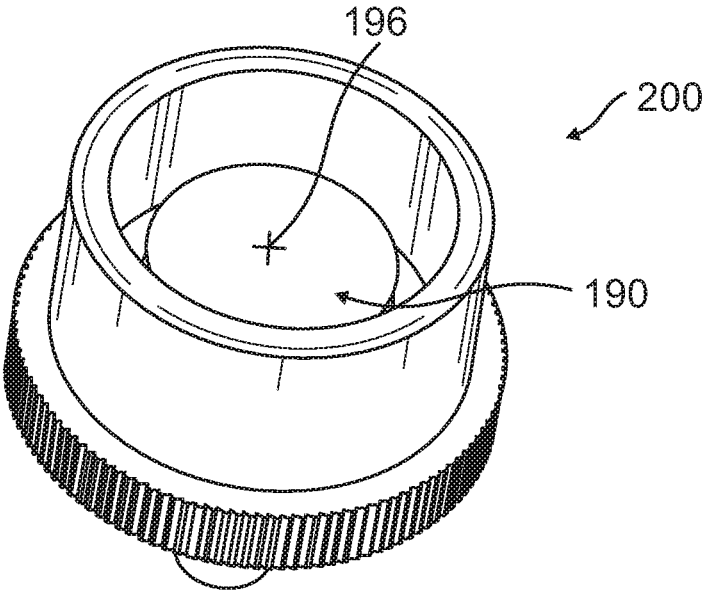
FIG. 3 is a top perspective view of the housing retaining the one-way nipple release valve.
Figure 4:
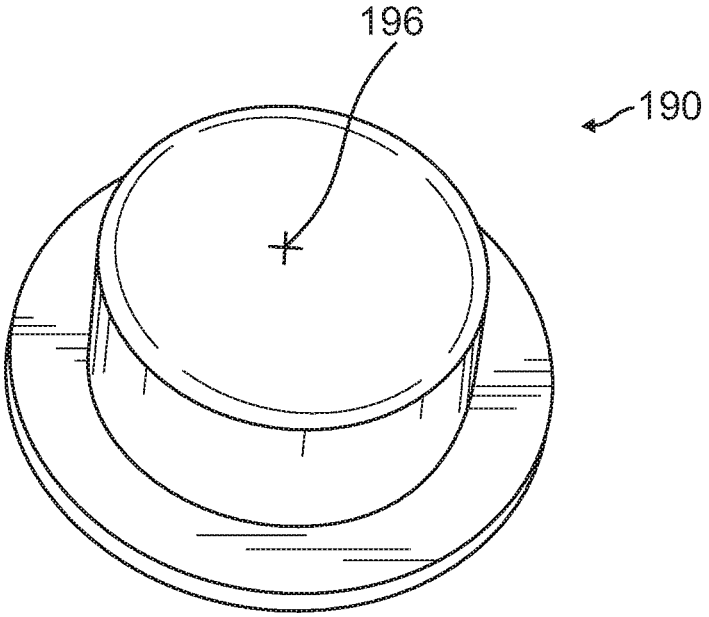
FIG. 4 is a perspective view of the one-way nipple release valve.

An alternative embodiment for the valve assembly is illustrated in FIGS. 3 and 4. The alternative embodiment of the valve assembly includes a one-way nipple valve 190 (see FIG. 3) is inserted and retained. A one-way nipple valve 190 is retained within the housing 200. The one-way nipple valve 190 has a nipple opening 196 in the one-way nipple valve 190.

Using the preferred embodiment of the valve assembly, when a downward pressure is exerted on the upper end cap 2030 or other components of the end cap section 2010, the downward force is translated through the lower end cap section, also called the integration member 2020, to create a force on the suction bellows 170 which creates a suction force within an interior chamber 120 of the liquid release bottle, the suction pressure that is created causes liquid to be forced through O-ring seal orifice 7302 which then forces duck-bill valve opening 7402 to open and allow liquid to pass through. The remaining fluid that is in flexible tubing 330 will pass through the tube because of air vent 8014 located on connection valve 8000 which allows the liquid that has been forced into flexible tubing 330 to flow completely out of flexible tubing 330.

Therefore, the principle by which the present invention works is that a liquid such as water or cleaning fluid 400 is retained within the interior chamber 120 surrounded by the interior surface 112 of the exterior wall 110 of the liquid release bottle 100. The liquid is poured into the liquid release bottle 100 through the liquid intake member 150 and is retained within interior chamber 120 because the above described valve assembly.

Using the alternative embodiment of the valve assembly, when a downward pressure is exerted on the upper end cap 2030 or other components of the end cap section 2010, the downward force is translated through the lower end cap section, also called the integration member 2020, to create a force on the suction bellows 170 which creates a suction force within an interior chamber 120 of the liquid release bottle 100 which causes the nipple opening 196 of the one-way nipple valve 190 to open, enabling liquid 400 which was retained in the interior chamber 120 to flow out of the one-way nipple valve 190 and to enter a flexible tubing 330 affixed to the shaft 210 extending from the housing 200 for the one-way nipple valve 190.

Therefore, the principle by which the alternate embodiment of the present invention works is that a liquid such as water or cleaning fluid 400 is retained within the interior chamber 120 surrounded by the interior surface 112 of the exterior wall 110 of the liquid release bottle 100. The liquid is poured into the liquid release bottle 100 through the liquid intake member 150 and is retained within interior chamber 120 because the one-way nipple valve 190 prevents liquid from flowing out of the chamber.

In the alternative valve embodiment, a downward force on the end cap 2030 of the handle 2100 causes the upper end cap section 2010 to impact the bellows member 170 to create an interior suction force within interior chamber 120 causing nipple opening 196 of the one-way nipple valve 190 to open enabling liquid 400 to flow through a flexible tubing 330. The flexible tubing 330 extends through interior chamber 2180 of the handle 2100 and through an aligned interior chamber 310 of yoke 340. The operation is that a force is created on the suction bellows member 170 which is integrated into the exterior wall 110 of the liquid release bottle 100 and thereafter, the suction on the suction bellows 170 causes the one-way nipple valve 190 to open so that liquid can flow through interior tubing 330. A cutout 320 in yoke 340 enables the open end 332 of tubing 330 to extend outwardly from the yoke 340 to enable the cleaning fluid 400 to be dispensed onto a location of a surface to be cleaned. The yoke 340 is affixed to the lower end of the mop handle 2100 at a location 342 and is affixed at end 344 to a coupling member 3170 which is attached to the top surface 3150 of flat mop 3000.

Figure 5:
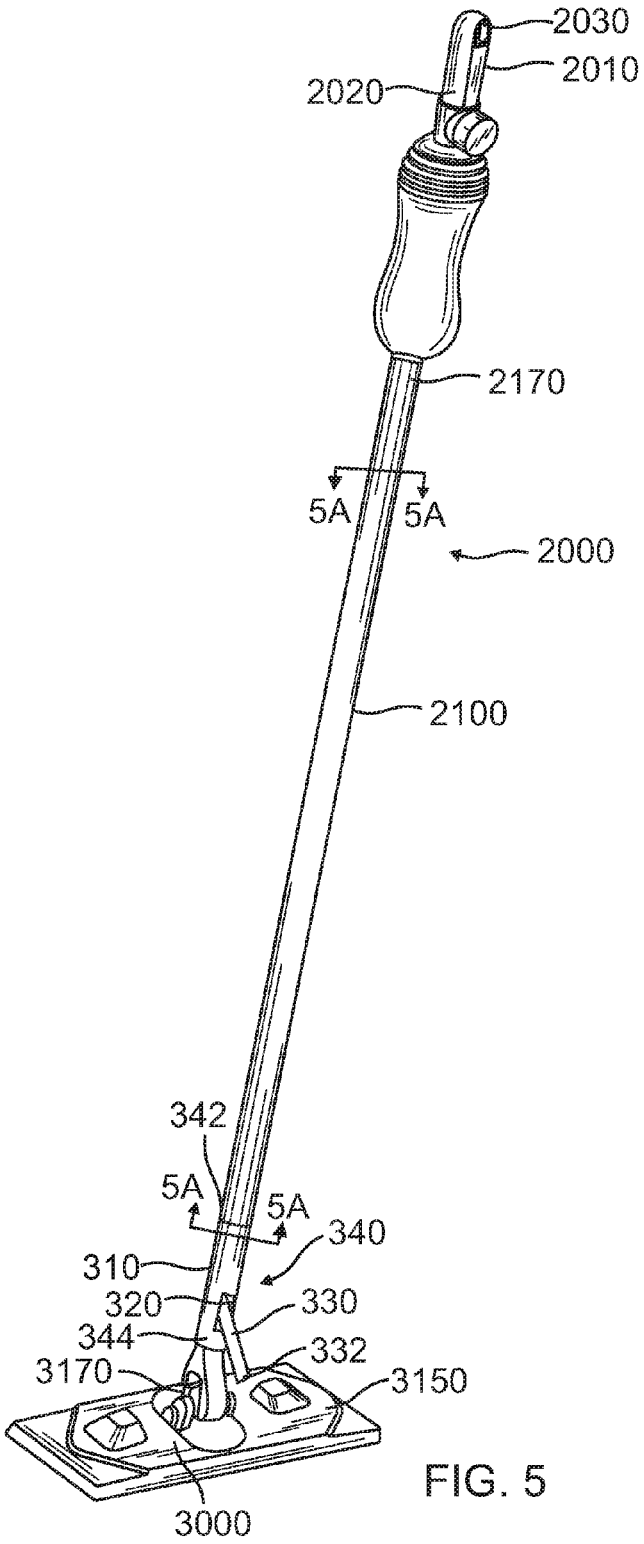
FIG. 5 is a perspective view of the preferred or first embodiment of the present invention liquid release bottle with suction bellows incorporated into the mop handle adjacent the top of the handle of the flat mop.
Figure 5A:
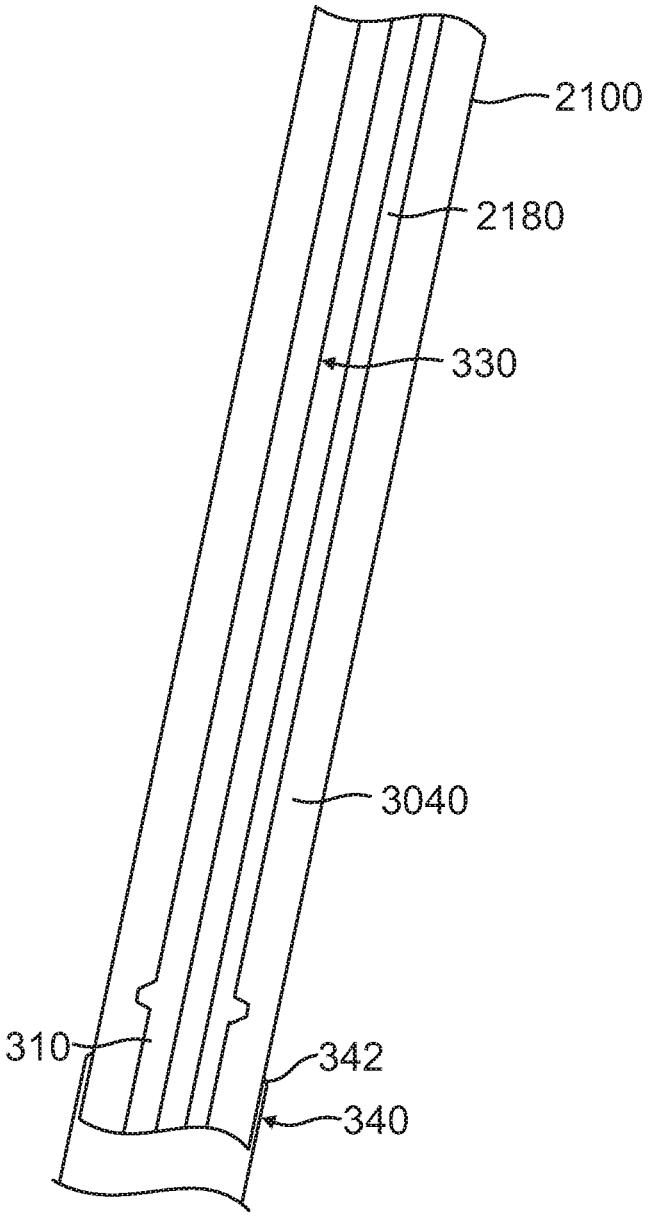
FIG. 5A is a longitudinal cross-sectional view between the bracketed sections 5A-5A of FIG. 5 to show internal chambers of the mop handle and the yoke as well as the flexible tube extending through both external chambers.
Figure 6:
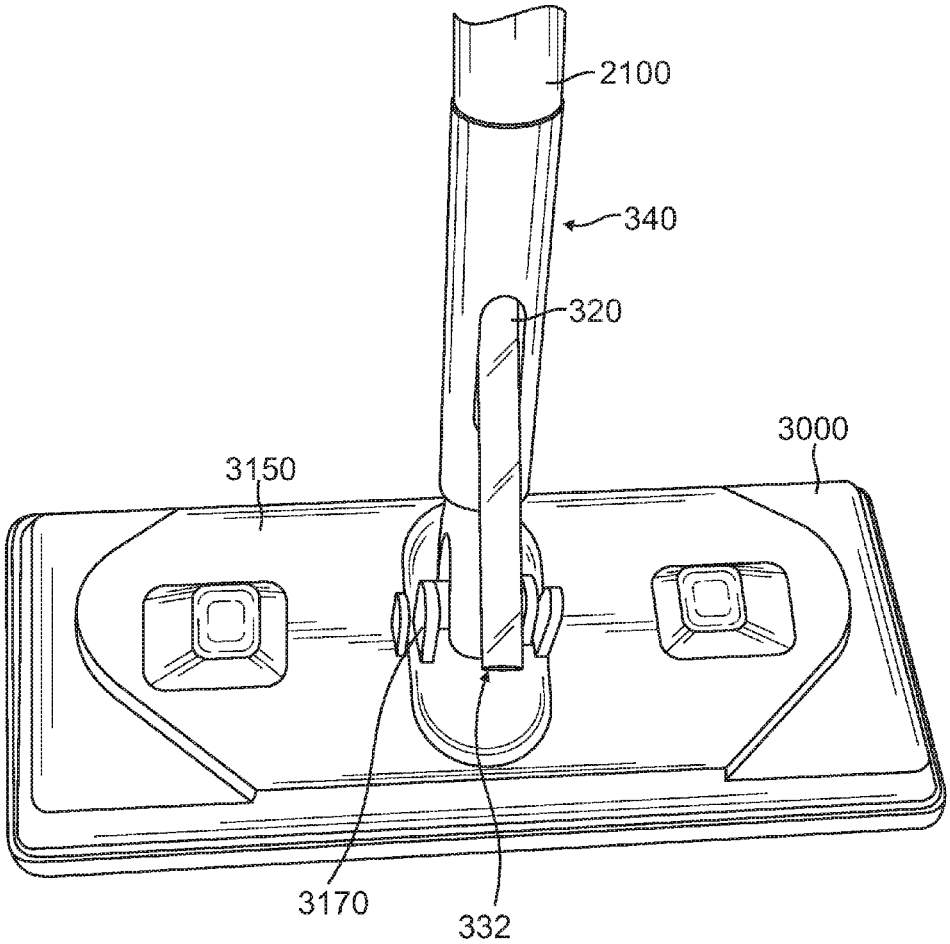
FIG. 6 is a close-up view of the cutout in the yoke and the bottom end of the flexible tubing extending out of the yoke adjacent the upper surface of the flat mop housing member.

To summarize, in the preferred embodiment illustrated in FIG. 5 and FIG. 5A, the liquid release bottle 100 with suction bellows 170 is incorporated adjacent an upper end of the mop handle 2100. In one variation, the mop handle 2100 has a two-piece end cap which includes a lower end cap section 2020 that connects to and is affixed to an upper end cap section 2010. Lower end cap section 2020 is affixed to the upper collar 130 of the liquid release bottle 100. A flexible tubing 330 is affixed to a handle interior channel opening 8502 which is in fluid communication with a bottom valve opening 8010. The flexible tubing 330 needs to be long enough to extend through the aligned interior chambers 2180 and 310 through cutout 320 of yoke 340. Therefore, when a downward pressure on the end cap 2010 is applied, this creates a downward and upward movement on the flexible bellows 170 in the liquid release bottle 100 so that the flexible bellows 170 creates a suction force to cause the one-way nipple valve 190 to open, thereby releasing liquid within the interior chamber 120 to be released and flow out the open end 332 of the flexible tubing 330.

Described in detail, the first embodiment is an apparatus adopted for use with a flat mop 2000 including a handle 2100 having a distal end and a proximal end, a yoke 340 having a distal end affixed to the proximal end of the handle at location 342, the yoke having a proximal end 344 movably affixed to a coupling member 3170 affixed to a flat mop 3000, the apparatus comprising: (a) a fluid dispenser having a liquid release bottle with suction bellows 100 incorporated into the handle 2100, the suction bellows 170 at a location adjacent to the distal end of the flat mop, the liquid release bottle with suction bellows 100 including an exterior wall 110, the release bottle and suction bellowing having an interior surface 112 surrounding an interior chamber 120, an upper collar 140 having a proximal end 142 affixed to and in fluid communication with a distal end 172 of the suction bellows 170, a blocking member 130 having a proximal end 132 affixed to the upper collar 140, the blocking member 130 having a distal end 134 affixed to a proximal end 2022 of an integration member 2020, the integration the member 2020 having a distal end 2024 affixed to an a handle end cap 2030, the upper collar 140 in fluid communication with a liquid intake member 150 covered by a covering cap 160; (b) the handle 2100 having a handle longitudinal interior channel 2180 extending from a location adjacent a lower end of said liquid release bottle to the proximal end 342 of the yoke 340, said yoke having a yoke longitudinal interior channel 310 extending from the location 342 where the yoke 340 is connected to said handle 2100 to a cutout 320 in said yoke, the handle longitudinal interior channel 2180 aligned with the yoke longitudinal interior channel 310; and (c) the liquid release bottle with suction bellows 100 further includes a collar 180 integrally formed with the liquid release bottle with suction bellows 100 at its proximal end 116, a connection valve assembly 8000 is retained within collar 180, and includes a seal orifice 7302 including an O-ring seal 7300, a duck-bill valve 7400 with an interior opening 7402, and an air vent 8014, both O-ring orifice 7302 and duck-bill valve 7400 fit inside of upper cylindrical portion 8007 of connection valve 8000, in addition. connection valve 8000 has a bottom valve opening 8010 that connects to flexible tubing 330 by bottom valve opening 8010 being surrounded by bottom valve external circumferential wall 8012 that has a diameter sized to press fit and form an airtight connection with handle interior channel opening 8502 at the distal end 334 of flexible tubing 330; which extends through said aligned handle longitudinal interior channel and said yoke longitudinal interior channel, the flexible tubing 330 extending out of said cutout in said yoke and terminating at a proximal end 332 adjacent an upper surface 3150 of the flat mop 3000; (d) whereby the interior chamber of the liquid release bottle is filled with cleaning liquid 400 through the liquid intake member after the covering cap is removed and after the covering cap is replaced, a downward force on the end cap causes the suction bellows to create an interior suction within the interior chamber of the liquid release bottle, thereby causing the duck-bill valve valve to open and enabling cleaning liquid to be dispensed through the flexible tubing, the cleaning liquid flowing out of the proximal end of the tubing and at a location distal end from said flat mop and onto a surface to be cleaned by the flat mop.

Figure 7:
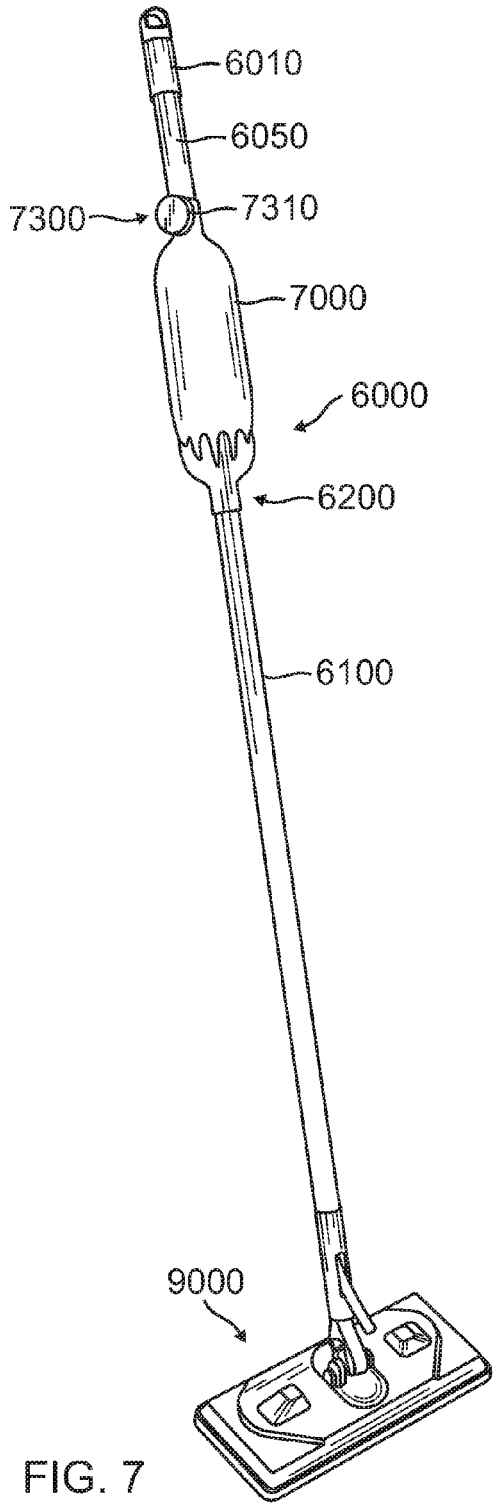
FIG. 7 is a perspective view of the alternative embodiment or second embodiment of the present invention liquid squeeze bottle incorporated into a flat mop with the alternative embodiment liquid squeeze bottle affixed adjacent the top of the handle of the flat mop.
Figure 8:
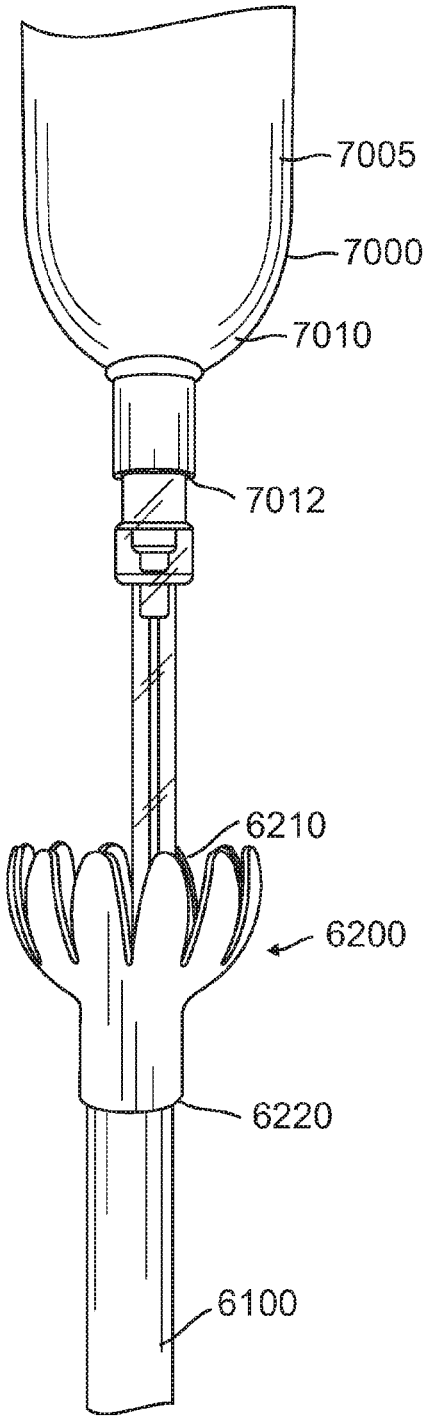
FIG. 8 is a close-up partially exploded view of the alternative or second embodiment of the present invention liquid squeeze bottle showing the flexible tube connected to the liquid squeeze bottle by a connection valve.
Figure 9:
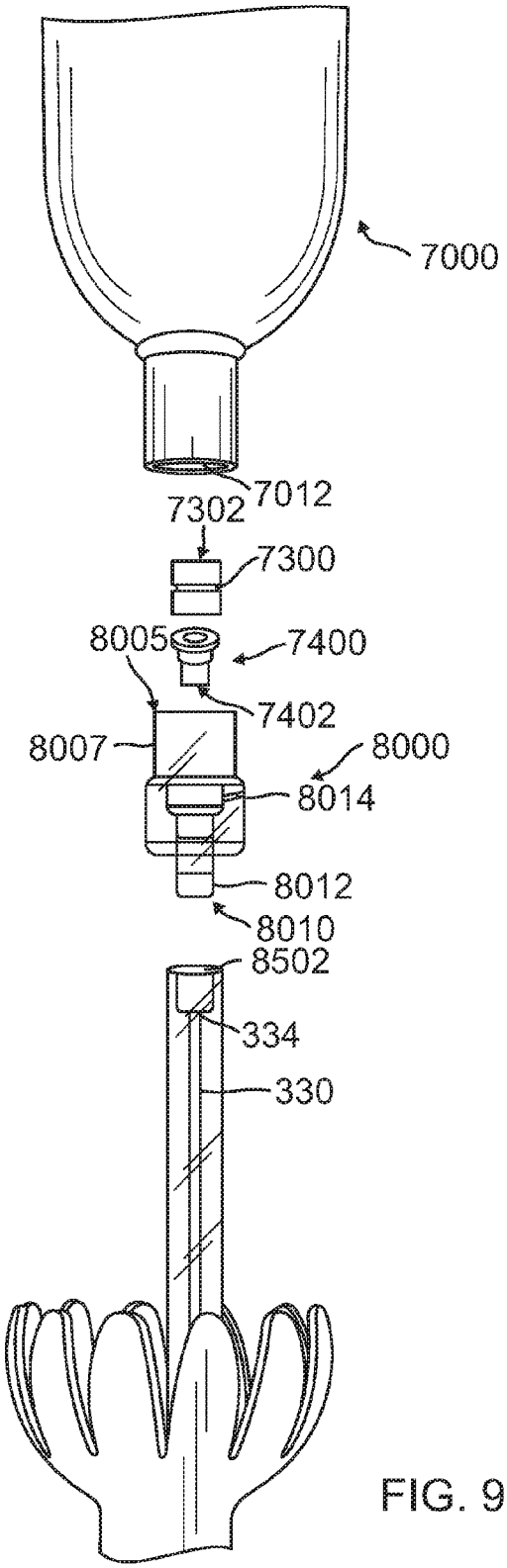
FIG. 9 is a partially exploded view of the alternative embodiment or second embodiment of the present invention liquid squeeze bottle showing the flexible tube connected to the liquid squeeze bottle by a connection valve, a duck-bill valve or an O-ring.

Referring to FIGS. 7, 8 and 9, there is illustrated an alternative or second variation 6000, replacing the liquid release bottle and suction bellows with a liquid squeeze bottle 7000 which rests upon liquid squeeze bottle holder 6200. Liquid squeeze bottle holder 6200 has a lower circular opening 6220 and that fits over lower extension handle 6100. Liquid squeeze bottle holder 6200 also has a holder top surface 6210 that liquid squeeze bottle exterior surface 7010 rests within during use.

Liquid squeeze bottle 7000 has a liquid squeeze bottle interior chamber 7005 that can be filled with liquid such as a cleaning solution that can be dispensed by the user during use by squeezing liquid squeeze bottle 7000. Liquid squeeze bottle cap 7300 is affixed to the top portion of liquid squeeze bottle 7000 by internal and external threads and can be loosened and removed from liquid squeeze bottle 7000 to expose liquid squeeze bottle top opening 7310. Liquid squeeze bottle top opening 7310 can be used to fill liquid squeeze bottle interior chamber 7005 with liquid or cleaning solution.

Referring to FIGS. 7 through 9, there is illustrated the liquid squeeze bottle 7000 having a liquid squeeze bottle bottom opening 7012 that connects to connection valve 8000 having a circular top valve opening 8005 that press fits to liquid squeeze bottle bottom opening 7012 and forms an airtight connection. Similarly, connection valve 8000 has a bottom valve opening 8010 that connects to flexible tubing 330 by bottom valve opening 8010 being surrounded by bottom valve external circumferential wall 8012 that has a diameter sized to press fit and form an airtight connection.

Referring to FIGS. 8 and 9, the exploded view of connection valve 8000 and liquid squeeze bottle 7000 is shown. Also illustrated in FIG. 8 is O-ring seal 7300 and duck-bill valve 7400. Both O-ring seal 7300 and duck-bill valve 7400 fit inside of upper cylindrical portion 8007 of connection valve 8000. When connected together, as shown in FIG. 8, connection valve 8000 functions to allow liquid that is located inside of liquid squeeze bottle 7000 to flow from liquid squeeze bottle 7000 through the length of flexible tubing 330 within tube interior chamber 8502 and out of the yoke cutout as previously described. The fluid pressure that is created by the squeezing of liquid squeeze bottle 7000 causes liquid to be forced through O-ring seal orifice 7302 which then forces duck-bill valve opening 7402 to open and allow liquid to pass through. When the user no longer squeezes the liquid squeeze bottle, the fluid pressure is reduced and duck-bill valve 7400 closes. The remaining fluid that is in flexible tubing 330 will pass through tube interior chamber 8502 of flexible tubing 330 because of air vent 8014. Air vent 8014 located on connection valve 8000 allows the liquid that has been squeezed into flexible tubing 330 to flow completely out of flexible tubing 330.

The operation is the same as previously described but instead of the bellows on the liquid squeeze bottle, the liquid squeeze bottle is directly squeezed to create the pressure to enable the cleaning liquid to flow through the flexible tubing and be discharged in front of the flat mop housing 2000.

In all embodiments, the distal end 342 of yoke 340 is crimped or otherwise affixed to handle 2100 and the proximal end 344 yoke 340 is movably affixed which in turn is affixed to the top surface 3150 and 3000.

Described in detail, the second embodiment of the present invention is an apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising: (a) a liquid squeeze bottle incorporated into the handle, the liquid squeeze bottle having an exterior surface and an interior surface surrounding an interior chamber, a fluid intake member affixed to and in fluid communication with the liquid squeeze bottle; (b) the liquid squeeze bottle retained by a liquid squeeze bottle holder having a lower opening that connects to and is in fluid communication with a connection valve having an O-ring seal and duck-bill valve within an upper cylindrical portion of connection valve, the connection valve having a bottom valve opening connected to and in fluid communication with a distal end of a flexible tubing; (c) the handle having a handle longitudinal interior channel extending from a location adjacent a lower end of said liquid squeeze bottle and the connection valve to the proximal end of the yoke, said yoke having a yoke longitudinal interior channel extending from the location where the yoke is connected to said handle to a cutout in said yoke, the handle longitudinal interior channel aligned with the yoke longitudinal interior channel; and (d) the flexible tubing extending through said aligned handle longitudinal interior channel and said yoke longitudinal interior channel, the flexible tubing extending out of said cutout in said yoke and terminating at a proximal end adjacent an upper surface of the flat mop; (e) whereby the interior chamber of the liquid release bottle is filled with cleaning liquid through the liquid intake member and a squeezing force on the liquid squeeze bottle causes the duck-bill valve to open and enabling cleaning liquid to be dispensed through the flexible tubing, the cleaning liquid flowing out of the proximal end of the tubing and at a location distal from said flat mop and onto a surface to be cleaned by the flat mop.

Preferably, the liquid squeeze bottle is located adjacent the distal end of said handle.

The following are typical dimensions used for both the liquid release bottle and liquid squeeze bottle embodiments:

1. air vent 8014 has an inside diameter of approximately 0.062 inches;

2. O-ring seal orifice 7302 has an inside diameter of approximately 0.125 inches;

3. tube interior chamber has an inside diameter of approximately 0.125 inches;

4. flexible tubing 330 has an outside diameter of approximately 0.25 inches;

5. liquid release bottle bottom opening 7012 has an outside diameter of approximately 0.125 inches; and 6. connection valve 8000 has an outside diameter of approximately 0.75 inches;

These dimensions can be larger or smaller than those listed in this specification and it is within the spirit and scope of this invention to include diameters that are both larger and smaller than the typical values listed.

It will be appreciated that the present invention can be incorporated into any type of mop including, but not limited to, the flat mop disclosed in FIGS. 7 and 10 including the flat mop claimed in the '092 patent or any variations therefore.

Since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising:

a. a fluid dispenser having a liquid release bottle with suction bellows incorporated into the handle, the suction bellows at a location adjacent to the distal end of the flat mop, the liquid release bottle with suction bellows including an exterior wall, the release bottle and suction bellowing having an interior surface surrounding an interior chamber, an upper collar having a proximal end affixed to and in fluid communication with a distal end of the suction bellows, a blocking member having a proximal end affixed to the upper collar, the blocking member having a distal end affixed to a proximal end of an integration member, the integration member having a distal end affixed to a handle end cap, the upper collar in fluid communication with a liquid intake member covered by a covering cap;

b. the handle having a handle longitudinal interior channel extending from a location adjacent a lower end of said liquid release bottle to the proximal end of the yoke, said yoke having a yoke longitudinal interior channel extending from the location where the yoke is connected to said handle to a cutout in said yoke, the handle longitudinal interior channel aligned with the yoke longitudinal interior channel; and c. the liquid release bottle with suction bellows further includes a collar integrally formed with the liquid release bottle with suction bellows at its proximal end, a connection valve assembly is retained within collar and includes a seal orifice including an O-ring seal, a duck-bill valve with an interior opening, and an air vent, both the O-ring orifice and the duck-bill valve fit inside upper the cylindrical portion of the connection valve, in addition, the connection valve has a bottom valve opening that connects to the flexible tubing by a bottom valve opening being surrounded by a bottom valve external circumferential wall that has a diameter sized to press fit and form an airtight connection with a handle interior channel opening of the handle at the distal end of the flexible tubing which extends through said aligned handle longitudinal interior channel and said yoke longitudinal interior channel, the flexible tubing extending out of said cutout in said yoke and terminating at a proximal end adjacent an upper surface of the flat mop;

d. whereby the interior chamber of the liquid release bottle is filled with cleaning liquid through the liquid intake member after the covering cap is removed and after the covering cap is replaced, a downward force on the end cap causes the suction bellows to create an interior suction within the interior chamber of the liquid release bottle, thereby causing the duck-bill valve to open and enabling cleaning liquid to be dispensed through the flexible tubing, the cleaning liquid flowing out of the proximal end of the tubing and at a location distal from said flat mop and onto a surface to be cleaned by the flat mop.

2. An apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising:

a. a fluid dispenser having a liquid release bottle with suction bellows incorporated into the handle, the liquid release bottle with suction bellows including an exterior wall, the release bottle and suction bellowing having an interior surface surrounding an interior chamber, an upper collar having a proximal end affixed to and in fluid communication with a distal end of the suction bellows, a blocking member having a proximal end affixed to the upper collar, the blocking member having a distal end affixed to a proximal end of an integration member, the integration the member having a distal end affixed to a handle end cap, the upper collar in fluid communication with a liquid intake member covered by a covering cap;

b. the handle having a handle longitudinal interior channel extending from a location adjacent a lower end of said liquid release bottle to the proximal end of the yoke, said yoke having a yoke longitudinal interior channel extending from the location where the yoke is connected to said handle to a cutout in said yoke, the handle longitudinal interior channel aligned with the yoke longitudinal interior channel; and c. the liquid release bottle with suction bellows further includes a collar integrally formed with the liquid release bottle with suction bellows at its proximal end, a connection valve assembly is retained within collar and includes a seal orifice including an O-ring seal, a duck-bill valve with an interior opening, and an air vent, both the O-ring orifice and the duck-bill valve fit inside the upper cylindrical portion of the connection valve, in addition, the connection valve has a bottom valve opening that connects to the flexible tubing by a bottom valve opening being surrounded by a bottom valve external circumferential wall that has a diameter sized to press fit and form an airtight connection with a handle interior channel opening of the handle at the distal end of the flexible tubing which extends through said aligned handle longitudinal interior channel and said yoke longitudinal interior channel, the flexible tubing extending out of said cutout in said yoke and terminating at a proximal end adjacent an upper surface of the flat mop.

3. The apparatus in accordance with claim 2, further comprising: said liquid release bottle is located adjacent to the distal end of said handle.

4. An apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising:

a. a fluid dispenser having a liquid release bottle with suction bellows incorporated into the handle, the suction bellows at a location adjacent to the distal end of the flat mop, the liquid release bottle with suction bellows including an exterior wall, the release bottle and suction bellowing having an interior surface surrounding an interior chamber, an upper collar having a proximal end affixed to and in fluid communication with a distal end of the suction bellows, a blocking member having a proximal end affixed to the upper collar, the blocking member having a distal end affixed to a proximal end of an integration member, the integration member having a distal end affixed to a handle end cap, the upper collar in fluid communication with a liquid intake member covered by a covering cap;

b. the handle having a handle longitudinal interior channel extending from a location adjacent a lower end of said liquid release bottle to the proximal end of the yoke, said yoke having a yoke longitudinal interior channel extending from the location where the yoke is connected to said handle to a cutout in said yoke, the handle longitudinal interior channel aligned with the yoke longitudinal interior channel; and c. the liquid release bottle having a proximal end in fluid communication with a one-way valve and in fluid communication with a distal end of a flexible tubing which extends through said aligned handle longitudinal interior channel and said yoke longitudinal interior channel, the flexible tubing extending out of said cutout in said yoke and terminating at a proximal end adjacent an upper surface of the flat mop.

5. The apparatus in accordance with claim 4, further comprising: said liquid release bottle is located adjacent to the distal end of said handle.

6. An apparatus adopted for use with a flat mop including a handle having a distal end and a proximal end, a yoke having a distal end affixed to the proximal end of the handle, the yoke having a proximal end movably affixed to a coupling member affixed to a flat mop, the apparatus comprising:

a. a fluid dispenser having a liquid squeeze bottle incorporated into the handle, the liquid squeeze bottle including an exterior wall and an interior surface surrounding an interior chamber, an upper collar having a proximal end affixed to and in fluid communication with a distal end of the liquid squeeze bottle, a blocking member having a proximal end affixed to the upper collar, the blocking member having a distal end affixed to a proximal end of an integration member, the integration member having a distal end affixed to a handle end cap, the upper collar in fluid communication with a liquid intake member covered by a covering cap;

b. the liquid squeeze bottle retained by a liquid squeeze bottle holder having a lower opening that connects to and is in fluid communication with a connection valve having a bottom valve opening connected to and in fluid communication with a distal end of a flexible tubing extending through a longitudinal interior channel in the handle and a yoke longitudinal interior channel, the flexible tubing extending out of a cutout in said yoke and terminating at a proximal end adjacent an upper surface of the flat mop.

7. The apparatus in accordance with claim 6, further comprising: said liquid release bottle is located adjacent to the distal end of said handle.

8. An apparatus in accordance with claim 6, further comprising: said connection valve includes a duck-bill valve.

9. An apparatus in accordance with claim 6, further comprising: said connection valve includes a one-way valve.

* * * * *